United States Patent [19]

Nishimoto

[11] Patent Number: 4,757,339

[45] Date of Patent: Jul. 12, 1988

[54] DISC FILM TREATING CASSETTE

[75] Inventor: Kanichi Nishimoto, Wakayama, Japan

[73] Assignee: Noritsu Kenkyu Center Co., Ltd., Wakayama, Japan

[21] Appl. No.: 10,422

[22] Filed: Feb. 3, 1987

[30] Foreign Application Priority Data

Feb. 10, 1986 [JP] Japan ..... 61-16829[U]
Feb. 10, 1986 [JP] Japan ..... 61-16831[U]
Jun. 16, 1986 [JP] Japan ..... 61-90565[U]

[51] Int. Cl.[4] ..... G03D 3/06
[52] U.S. Cl. ..... 354/312; 354/323; 354/329
[58] Field of Search ..... 354/307, 310, 311, 312, 354/315, 316, 323, 329, 330

[56] References Cited

U.S. PATENT DOCUMENTS

| | | | |
|---|---|---|---|
| 4,112,452 | 9/1978 | Patton | 354/322 |
| 4,112,453 | 9/1978 | Hutchison | 354/330 |
| 4,112,454 | 9/1978 | Harvey | 354/330 |
| 4,134,666 | 1/1979 | Kikuchi | 354/329 |
| 4,167,320 | 9/1979 | Hutchison | 354/323 |
| 4,178,091 | 12/1979 | Solomon | 354/322 |
| 4,252,430 | 2/1981 | Michal | 354/322 |
| 4,502,772 | 3/1985 | Mihara | 354/312 |

*Primary Examiner*—A. A. Mathews
*Attorney, Agent, or Firm*—Larson & Taylor

[57] ABSTRACT

This disc film treating cassette comprises a housing including a tubular portion and a top wall in an inverted cup-shaped configuration in which several disc films can be accommodated, a disc film support shaft rotatably and slidably supported at the central part of the top wall of the housing to rotate in the latter and slide in the axial direction thereof and a light shielding plate adapted to lighttightly close the opening at the lower end of the housing.

7 Claims, 4 Drawing Sheets

DISC FILM TREATING CASSETTE

BACKGROUND OF THE INVENTION

1. Field of the Invention

The present invention relates to a disc film treating cassette employable for a disc film treating apparatus and more particularly to a disc film treating cassette which is used when, due to the current reduced demand for disc films, only a small number of disc films are treated for developing them and which can be used also as magazine for disc films to be treated.

2. Description of the Prior Art

In recent years, a disc-shaped photographic film that is called disc film and has an outer diameter is dimensioned to about 6.5 cm and which is formed with a fitting hole having an inner diameter of about 1 cm at the central part and has a number of exposure portions for photographing arranged in the equally spaced relation in the area located adjacent to the periphery thereof has been developed to be in use in place of conventional strips of photographic films which have been used widely.

In connection with the development of disc films as mentioned above there were already made a variety of proposals as to treating apparatus, treating machines and associated devices usable for carrying out a series of so-called developing treatments for disc films ranging from developing to stabilizing as disclosed in, for instance U.S. Pat. Nos. 4,112,452, 4,112,453, 4,112,454 (British Pat. No. 1602492), U.S. Pat. Nos. 4,167,320, 4,178,091 and 4,252,430. However each of the above-noted prior inventions concerning apparatus, machine and device is made in compliance with the conventional treating process or system for treating a large number of photographic films at a highly increased operational efficiency. Accordingly, employment of the conventional treating process or system is not economically advantageous and has reduced practicability due to the current situation that an amount of consumption of disc films is at a low level.

In view of the fact as mentioned above, inventors who work with the assignee of the present application developed an apparatus for treating disc films as disclosed in U.S. Pat. No. 4,502,772, British Pat. No. 2122771 and German Pat. No. 3317814. This apparatus is so constructed that an improved treating unit for treating disc films is attached to a treating unit for treating conventional photosensitive material such as strip of photographic film, printing paper or the like in order to assure an increased economical effect. However, the apparatus of the prior inventions is based on the hitherto known technical concept that there is a necessity for a dark box which unavoidably has considerable operational inconvenience in the same way as the conventional treating apparatus for treating a large number of photosensitive material such as strip of photographic film, printing paper or the like. Accordingly, the apparatus has a problem as an apparatus for treating a small number of disc films from the viewpoint of economy. This means that not only the conventional apparatus and machines but also associated devices which are intended to be in use for treating a very small number of disc films have problems that there is a necessity for certain trained skill for handling them, there is still left bad operational economy and there is low practicability.

To obviate the foregoing problems the inventors of the present invention conducted a number of works for searching for the reasons why the problems took place. In consequence, they reached a conclusion that a series of developing treatments can be carried out even in a bright room by improving the disc film support means which is used for treating apparatus, machines and associated devices each of which is used for developing disc films.

BRIEF SUMMARY OF THE INVENTION

Hence, the present invention has been made with the foregoing background in mind.

A main object of the present invention is to provide a disc film treating cassette employable for a treating apparatus which assures that a series of treatments can be carried out for a small number of disc films even in a bright room apart away from the conventionally established technical concept that they are carried out in a dark room or box.

Another object of the present invention is to provide a disc film treating cassette employable for a treating apparatus which is simple in structure and can be easily operated in view of the fact that demand for and consumption of disc films are still at a low level and therefore utilization of them is not popular at present.

Another object of the present invention is to provide a disc film treating cassette employable for a treating apparatus which assures that a small number of disc films can be treated simply and easily at every time when treating is effected with the use of the cassette.

Further another object of the present invention is to provide a disc film treating cassette employable for a treating apparatus which serves also as a magazine for several number of disc films of which exposure has been completed.

To accomplish the above objects there is proposed a disc film treating cassette comprising a housing including a tubular portion and a top wall in an inverted cup-shaped configuration in which a plurality of disc films can be accommodated, a disc film support shaft rotatably and slidably supported at the central part of the top wall of the housing to rotate in the latter and slide in the axial direction thereof, and a light shielding plate adapted to lighttightly close the opening at the lower end of the housing.

Other objects, features and advantages of the present invention will become readily apparent from reading of the following description which has been prepared in conjunction with the accompanying drawings.

BRIEF DESCRIPTION OF THE DRAWINGS

The accompanying drawings will be briefly described below. They schematically illustrate a disc film treating cassette in accordance with a preferred embodiment of the present invention as well as a disc film treating apparatus for which the cassette is employed. The treating apparatus comprises a treating unit for conventional photosensitive material such as strip of photographic film, printing paper or the like and a disc film treating unit attached to the first-mentioned treating unit in the side-by-side relation so that treatments for disc films are carried out in a bright room. The drawings are prepared to such an extent that they can be easily understood by any expert in the art to which the present invention pertains, although components which could be easily understood by him are not illustrated as far as possible for the purpose of simplification.

DESCRIPTION OF THE PREFERRED EMBODIMENT

Now, the present invention will be described in greater detail hereunder with reference to the accompanying drawings which illustrate a preferred embodiment thereof.

Figure 1:
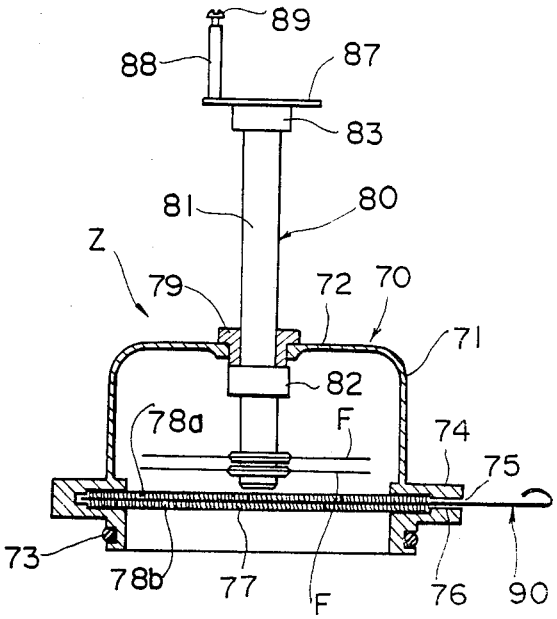
FIG. 1 is a vertical sectional view of a disc film treating cassette in accordance with an embodiment of the invention.
Figure 2:
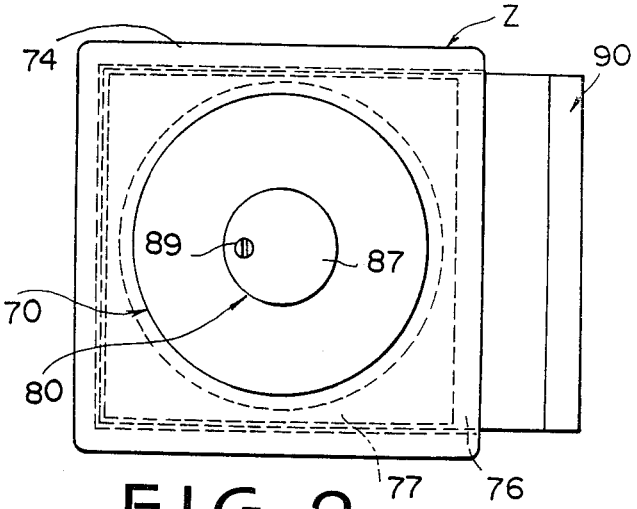
FIG. 2 is a plan view of the disc film treating cassette in FIG. 1.

Refering to FIGS. 1 and 2, particularly to FIG. 1, reference F designates several number of disc films which have latent images and reference symbol Z designates a disc film treating cassette which serves also as a magazine for the disc films F. The cassette Z is constituted essentially by a housing 70, a disc film support shaft 80 and a light shielding plate 90 which is subjected to mat finishing.

The housing 70 comprises a tubular portion 71 in which several number of disc films F can be accommodated and a top wall 72 with a through hole formed at the central area thereof to build an inverted cup-shaped configuration. Further, the housing 70 is formed with a packing groove 73 on the circumferential surface at the lower end part of the tubular portion 71 which is fitted into a disc film treating tank 41 (see FIG. 4) to be described later and, moreover, it is provided with a substantially square engagement flange 74 at the position located slightly above the packing groove 73. An opening 75 is formed on the one side wall of the flange 74 and includes a slit 76 through which a light shielding plate 90 having a width larger than the inner diameter of the tubular portion 71 is inserted. As will be apparent from the drawings, the slit 76 has a enlarged portion 77 of which the vertical dimension is determined larger than the width of the slit 76 and plushes **78*a* and 78*b* acting as a light shielding member are attached to both the upper and lower surfaces of the enlarged portion 77 which are located opposite to one another. The through hole provided at the central area of the top wall 72 is fitted with a bushing 79 (which may be replaced with a bearing) serving as a holding member for rotatably supporting the disc film support shaft 80** in a lighttight manner.

Figure 3:
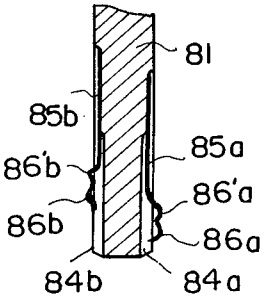
FIG. 3 is an enlarged vertical sectional view of the lower part of a disc film support shaft in the disc film treating cassette.

The disc film supporting shaft 80 includes as a main body a shank 81 of which the diameter is so dimensioned that it is inserted through a fitting hole of a disc film F and which is slidably supported through the hole of the bushing 79. Further, it includes a larger diameter stopper 82 positioned so that the lower end of the shank 81 is located slightly above the light shielding member 90 when it is displaced upwardly and another larger diameter stopper 83 is positioned so that several disc films F carried by the lower end part of the support shaft 80 are immersed in treating liquid in the disc film treating tank 41 (see FIG. 4) to be described later when shaft 80 is displaced downwardly. Further, as shown in FIG. 3, it is formed with a plurality of axially extending grooves **84*a* and 84*b* at the lower end part thereof in which the upper end part of each of the leaf springs 85*a* and 85*b* is fixedly held. To assure that the disc films F are fixedly fitted on the support shaft 80 in such a closely spaced relation as shown in FIG. 1, the leaf springs 85*a* and 85*b* are formed with a plurality of projections 86'*a*, 86*a'*, *86b* and 86'*b*, as will be best seen in FIG. 3. The projections and parts located in the vicinity of the projections are projected outwardly of the grooves 84*a* and 84*b*. Moreover, it includes a circular disc 87 fixedly mounted on the stopper 83 and a support shaft 88 stands upright on the circular disc 87. The support shaft 88 is located at a position away from the axis of the support shaft 80 by a distance of $r_2$ which is determined larger than $r_1$ for a support shaft 62 so that the other end of a reciprocable movement transmission rod 63 (see FIGS. 5 and 7) to be described later is pivotally fitted onto the support shaft 88 with the aid of a retaining screw 89**.

Next, description will be made below with reference to FIGS. 4 to 7 as to an example of a photosensitive material treating apparatus for effectively and economically treating several disc films F in a bright room by using the disc film treating cassette Z which serves also as a magazine for the disc films F. The apparatus comprises a conventional treating unit similar to an automatic developing machine such as film processor manufactured and sold under the tradename of QSS by Noritsu Koki Co., Ltd. which is closely related to the assignee of the present application. That treating unit is used for treating photosensitive material such as strip of photographic film, printing paper or the like which is widely used on a large scale. A specific cassette for disc films F and the last-mentioned treating unit are attached to the first mentioned treating unit in the side-by-side relation.

Figure 5:
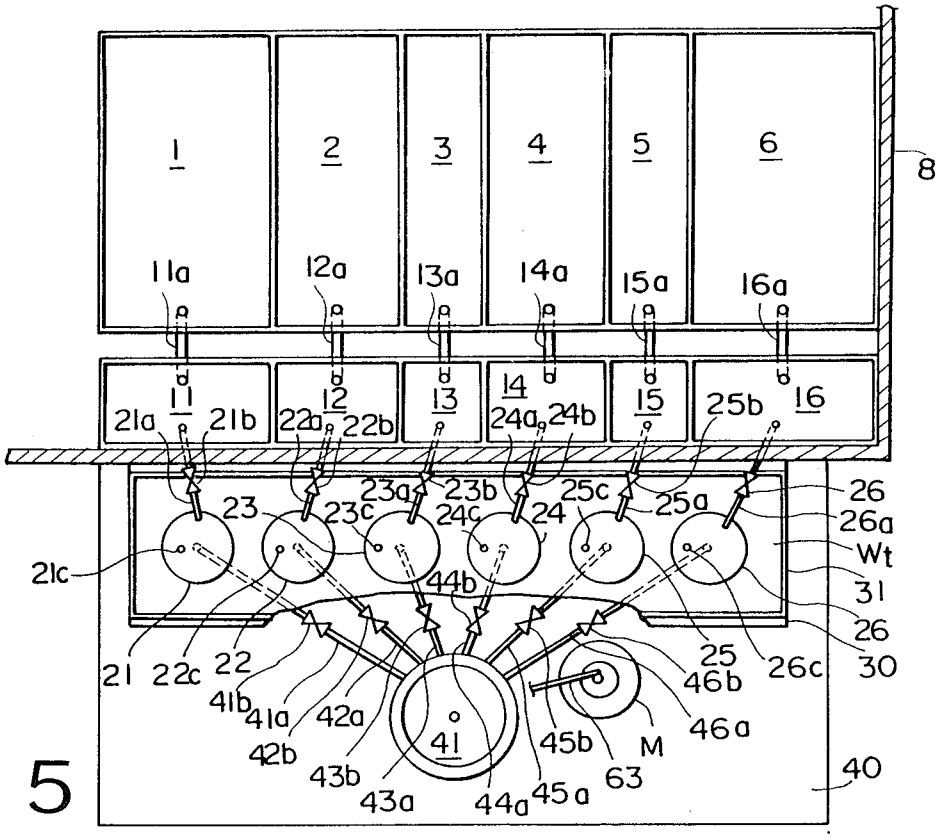
FIG. 5 is a schematic plan view of the treating apparatus in FIG. 4 which is illustrated in the same manner as in FIG. 4.
Figure 4:
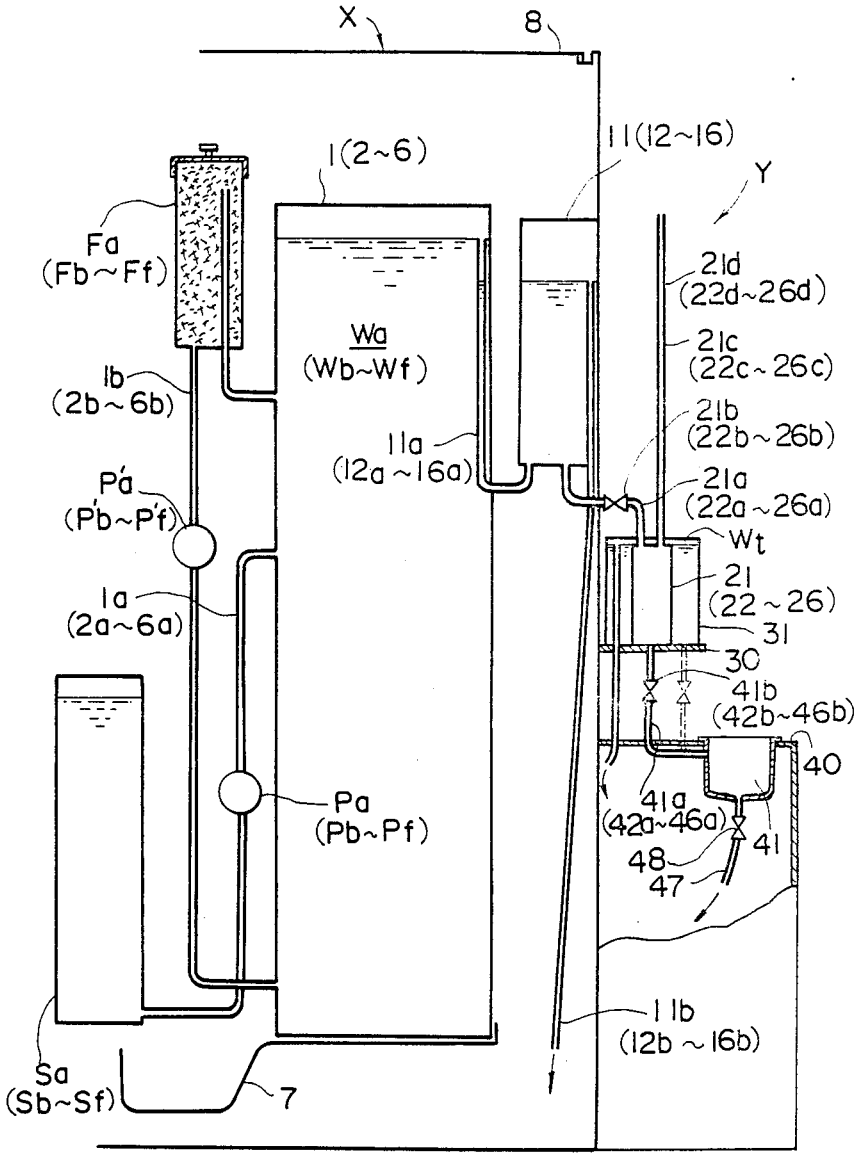
FIG. 4 is a schematic side view of a disc film treating apparatus of which part is not illustrated, of which another part is vertically sectioned and of which another part is cut away to clearly illustrate structure of the components thereof.

Refering particularly to FIGS. 4 and 5, a section as identified by reference symbol X is a treating unit similar to a conventional automatic developing machine for treating a strip of photographic film, for instance, a film processor manufactured and sold under a tradename of QSS by Noritsu Koki Co., Ltd. a section as identified by reference symbol Y is a treating unit for treating disc films. As will be readily apparent from the drawings, the treating apparatus is constituted by a combination of both the treating units X and Y which are closely associated with one another in respect of function and operation.

With reference to the treating unit X, reference numerals 1, 2, 3, 4, 5 and 6 designate a developing liquid bath, a bleaching liquid bath, a washing water bath, a fixing liquid bath, a washing water bath and a stabilizing liquid bath. These baths are arranged one after another in the interior of a dark box which is surrounded by an outer panel 8. They include treating liquid supply devices 1a, 2a, 3a, 4a, 5a and 6a which comprise treating liquid storage tanks Sa, Sb, Sc, Sd, Se and Sf and pumps Pa, Pb, Pc, Pd, Pe and Pf. Further, they include treating liquid circulating passages 1b, 2b, 3b, 4b, 5b and 6b which comprise pumps P'a, P'b, P'c, P'd, P'e and P'f and filters Fa, Fb, Fc, Fd, Fe and Ff. In addition, each of the treating baths is equipped with a thermostat for measuring a temperature of treating liquid, a heater for heating treating liquid incorporated in a protective tube and a water supply tube for supplying cooling water for cooling treating liquid each of which is not shown in the drawing for the purpose of simplification of illustration. Incidentally, reference numeral 7 designates a waste liquid tank and reference symbols Wa, Wb, Wc, Wd, We and Wf designate treating liquids. When the apparatus employs a waterless washing system which has been developed in the recent years and exhibits a tendency of increased usage, it is obvious that the above-mentioned components relative to water washing are not required.

Further, the treating unit Y for treating disc films F includes as main components first tanks 11, 12, 13, 14, 15 and 16 which are designed in an appreciably large size for storing overflown treating liquid and has overflow pipes 11a, 12a, 13a, 14a, 15a and 16a extending from the treating baths 1, 2, 3, 4, 5 and 6 of which other end is kept opened, second tanks 21, 22, 23, 24, 25 and 26 (which may be called metering tanks) which are communicated with the first tanks 11, 12, 13, 14, 15 and 16 via liquid introduction pipes 21a, 22a, 23a, 24a, 25a and 26a with valves 21b, 22b, 23b, 24b, 25b and 26b fitted thereto and include elongated air vent pipes 21c, 22c, 23c, 24c, 25c and 26c with liquid level detectors 21d, 22d, 23d, 24d, 25d and 26d attached thereto, a hot water bath 31 which is mounted on a platform 30 to maintain a temperature of treating liquids introduced into the second tanks 21, 22, 23, 24, 25 and 26 at a specified level of temperature suitable for treating disc film and includes an overflow pipe as well as a hot water supply device, a thermostat for measuring treating liquid temperature and a heater for heating hot water incorporated in a protective tube both of which are not shown in the drawing, and a disc film treating tank 41 mounted on a platform 40 to be communicated with the second tanks 21, 22, 23, 24, 25 and 26 via treating liquid supply pipes 41a, 42a, 43a, 44a, 45a and 46a with valves 41b, 42b, 43b, 44b, 45b and 46b so that treating liquids stored in the second tanks 21, 22, 23, 24, 25 and 26 can be successively delivered thereto only by a volume required for treating several number of disc films F, the disc film treating tank 41 having on the bottom a drain pipe 47 with a valve 48.

The valves 21b, 22b, 23b, 24b, 25b and 26b are so designed that they are opened while the valves 41b, 42b, 43b, 44b, 45b and 46b are closed, they are closed while the valves 41b, 42b, 43b, 44b, 45b and 46b are opened or liquid level is detected by the liquid level detectors 21d, 22d, 23d, 24d, 25d and 26d. The valves 41b, 42b, 43b, 44b, 45b and 46b are so designed that they closed while the valve 48 is opened. All valves may be opened and closed manually.

Figure 6:
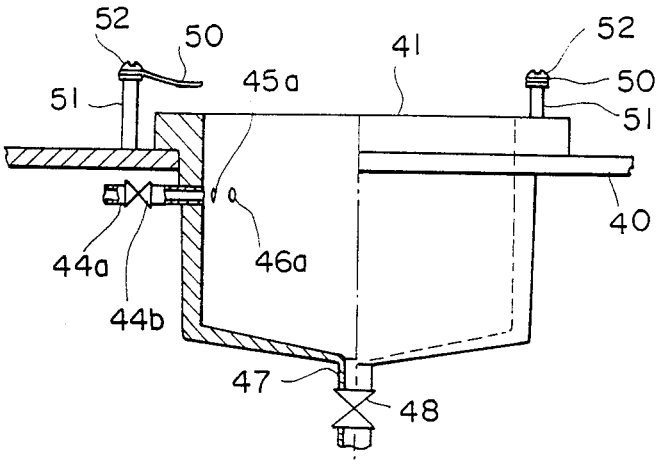
FIG. 6 is a side view of a disc film treating tank in the disc film treating unit as shown in FIGS. 4 and 5, wherein the left half of the treating tank is illustrated in the vertically sectioned state.
Figure 7:
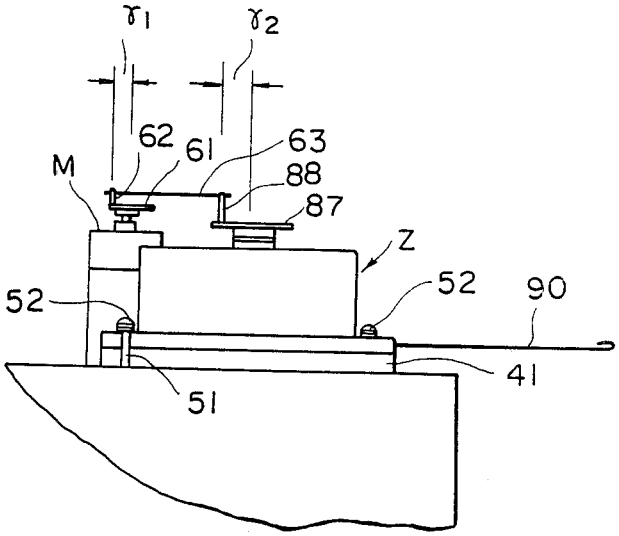
FIG. 7 is a fragmental schematic side view of the disc film treating unit as shown in FIGS. 4, 5 and 6, particularly illustrating that the disc film treating cassette as shown in FIGS. 1 to 3 is firmly mounted on the disc film treating tank in the operative state and, wherein insignificant components are not illustrated for the purpose of simplification.

Incidentally, reference symbol M designates a motor for reciprocably rotating a disc film support shaft in the disc film treating cassette Z as shown in FIGS. 5 and 7. Reference numeral 50 designates a cassette retaining spring which is held on the top of a support shaft 51 to turn about the latter with the aid of a screw 52 as shown in FIG. 6. As is apparent from the drawing, the support shaft 51 stands upright on the platform 40. Further, as shown in FIG. 7, a circular disc 61 fixedly mounted on the top of the rotational shaft of the motor M has a support shaft 62 located away from an axis thereof by a distance $r_1$ and a circular disc 87 fixedly mounted on a shaft 81 of the disc film support shaft 80 for the cassette Z placed on the disc film treating tank 41 and firmly held thereon by means of the leaf springs 50 has a support shaft 88 located away from an axis thereof by a distance $r_2$. The reciprocable movement transmission rod 63 is pivotally fitted onto the support shaft 88 with the aid of a screw 89 to bridge between both the support shafts 62 and 88 in order that rotation of the motor M is transmitted to the shaft 80 via the rod 63 to produce reciprocal movement, since the distance $r_2$ is larger than the distance $r_1$.

Since the photosensitive material treating apparatus is constructed in the above-described manner, a series of treatments which have been carried out for conventional photosensitive material such as a strip of photographic film are achieved in the treating unit X in the same manner as the conventional apparatus. Treating liquids Wa, Wb, Wc, Wd, We and Wf overflown from the treating baths 1, 2, 3, 4, 5 and 6 during treating operations are stored in the first tanks 11, 12, 13, 14, 15 and 16 via the overflow pipes 11a, 12a, 13a, 14a, 15a and 16a. Incidentally, an excessive volume of overflown liquids Wa, Wb, Wc, Wd, We and Wf are discharged into the waste liquid tank 7 via overflow pipes 11b, 12b, 13b, 14b, 15b and 16b.

When disc films F are to be subjected to certain treating, the light shielding plate 90 which closes the opening at the lower end of the tubular portion 71 constituting the housing 70 of the cassette Z and inhibits the support shaft 80 from being depressed is pulled in the sideward direction. Now, the support shaft 80 is ready to be depressed by an operator. Then, it is depressed until the stopper 83 abuts against the bushing 79 and its lower end part is fitted through the fitting holes on the disc films F which have latent image against resilient force of the leaf springs 85a and 85b in a dark room or the like place. Thus, the disc films F are firmly held on the support shaft 80 with the aid of the projections 86'a, 86'a, 86b and 86b' on the leaf springs 85a and 85b in such a state that they are inhibited from any rotation and displacement. Thereafter, as shown in FIG. 1, they are raised up until the stopper 82 abuts against the bushing 79 and the light shielding plate 90 is then inserted into the interior of the housing 70 again until the latter is completely shielded so as to inhibit any entrance of a light beam into the interior thereof.

After several exposed disc films F are lighttightly accommodated in the cassette Z in that way, the lower end part of the housing 70 of the cassette Z with the packing groove 73 formed thereon is fitted into the treating tank 41 of the treating unit Y and the square engagement flange 74 is placed on the same in the dark box. Then, the cassette Z is firmly held on the treating tank 41 under the effect of resilient force of the leaf springs 50 and thereafter the light shielding plate 90 is pulled outwardly to the position where there does not interfere with the support shaft 80 from being depressed. Next, the support shaft 80 is depressed until the stopper 83 abuts against the bushing 79 and the other end of the reciprocable movement transmission rod 63 is pivotally fitted onto the supporot shaft 88 with the aid of the retaining screw 89. Now, the disc films F are ready to be subjected to certain treating.

Next, by depressing operation buttons which are not shown in the drawings, the valve 41b, 42b, 43b, 44b, 45b and 46b on the treating liquid supply pipes 41a, 42a, 43a, 44a, 45a and 46a are closed and the valves 21b, 22b, 23b, 24b, 25b and 26 *b* on the treating liquid introduction pipes 21a, 22a, 23a, 24a, 25 *a* and 26a are opened whereby treating liquids Wa, Wb, Wc, Wd, We and Wf in the first tanks 11, 12, 13, 14, 15 and 16 are introduced into the second tanks 21, 22, 23, 24, 25 and 26. When the liquid level detector 21d, 22d, 23d, 24d, 25d and 26d on the air vent pipes 21c, 22c, 23c, 24c, 25c and 26c detect liquid level of treating liquids Wa, Wb, Wc, Wd, We and Wf, the valves 21b, 22b, 23b, 24b, 25b and 26b are closed in response to detection signal transmitted from the detectors 21d, 22d, 23d, 24d, 25d and 26d. On the other hand, hot water Wt in the hot water bath 31 is heated to keep it at a level of temperature most suitable for treating the disc films F.

Then, each of the treating liquids Wa, Wb, Wc, Wd, We and Wf in the second tanks 21, 22, 23, 24, 25 and 26 heated up to the optimum level of temperature suitable for treating disc films F is supplied to the single disc film treating tank 41 by successively opening the valves 41b, 42b, 43b, 44b, 45b and 46b in accordance with a predetermined order so that they are subjected to certain treating. After completion of the latter the valve 48 is opened and thereby treating liquid used therefor is drained from the treating tank 41.

After the valves 41b, 42b, 43b, 44b, 45b and 46b are closed, the valves 21b, 22b, 23b, 24b, 25b and 26b are opened and thereby treating liquids Wa, Wb, Wc, Wd, We and Wf stored in the first tanks 11, 12, 13, 14, 15 and 16 are introduced into the second tanks 21, 22, 23, 24, 25 and 26 from which treating liquids will be supplied to the treating tank 41 later. Now, next treating for disc films F is ready to be initiated.

In the illustrated embodiment each of the above-mentioned treatments is carried out in accordance with the conventional automatic treating system which has been employed for this kind of treatment. However, the present invention should not be limited only to this. Alternatively, they may be carried out manually.

Incidentally, in the case where the treating unit X is constructed in accordance with the specification of waterless washing for treating strip of photographic films F etc. but water washing becomes necessary for treating disc films F or in the case where the first tanks 13 and 15 and the second tanks 23 and 25 in which treating liquids Wc and We coming from the washing water baths 3 and 5 are stored are eliminated, treating liquid supply pipes 43aand 45a with valves 43band 45b fitted thereto may be communicated with the hot water bath 31 so as to permit hot water Wt in the hot water bath 31 to be used for the purpose of water washing, as represented by chain lines in FIG. 4. If the treating liquid introduction pipes 21a, 22a, 23a, 24a, 25a and 26a and the air vent pipes 21c, 22c, 23c, 24c, 25c and 26c are designed to have a reduced diameter (several millimeters), the valves 21b, 22b, 23b, 24b, 25b and 26b and the liquid level detectors 21d, 22d, 23d, 24d, 25d and 26d may be eliminated.

As will be readily apparent from the above description, advantageous features of the present invention reside in that in order to treat disc films F of relatively low demand a conventionally designed single treating apparatus is not employed but treating liquid overflown from each of treating baths which has been hitherto wasted with the conventional treating apparatus usable for treating photosensitive material such as strip of photographic film consumption has reached a very is effectively utilized in such a manner that only a volume of treating liquid required for certain treating is taken from one of tanks in which overflown liquid is stored, it is heated to a temperature suitable for treating disc films and it is then delivered to a single disc film treating tank 41 in accordance with a predetermined order of steps of treating disc films so that the latter are treated as required. Owing to the construction made for the invention in that way it is possible to treat disc films easily even when a small number of disc films have to be treated. Another advantageous features of the invention are that the cassette is simple in structure and has excellently high economical performance.

While the present invention has been described above only with respect to a single preferred embodiment, it should of course be understood that it should not be limited only to this but various changes or modifications may be made in any acceptable manner without departure from the spirit and scope of the invention as defined by the appended claims.

What is claimed is:

1. A disc film treating cassette comprising:

a housing including a tubular portion and a top wall in an inverted cup-shaped configuration in which a plurality of disc films can be accommodated;

a disc film support shaft rotatably and slidably supported at the central part of said top wall of said housing to rotate in the latter and slide in the axial direction thereof;

a light shielding plate having a width larger than the inner diameter of said tubular portion and being adapted to light tightly close the opening at the lower end of the housing;

said tubular portion of the housing having and engagement flange around the circumferential surface at the lower end thereof, said engagement flange coming in abutment against an upper end surface of a disc film treating tank when the lower end part of the housing is fitted into said disc film treating tank in a disc film treating unit in which a series of treatments are carried out for developing disc films;

said engagement flange defining a slit through which said light shielding plate having a width larger than the inner diameter of the tubular portion is inserted and wherein the engagement flange is further formed with an enlarged portion which is opened to the interior of the tubular portion, said enlarged portion having a width as seen in the vertical direction larger than the opening width of said slit, and both the upper and lower surfaces in the enlarged portion located opposite to one another being fitted with a light shielding member respectively.

2. A disc film treating cassette as defined in claim 1, wherein the top wall of the housing is provided with a bushing or bearing at the central part thereof for rotatably and slidably supporting said disc film support shaft in a lighttight manner.

3. A disc film treating cassette as defined in claim 1, wherein the tubular portion of the housing is fitted with a packing around the circumferential surface at the lower end part thereof to assure light sealabilty and watertightness when the lower end part of the housing is fitted into a disc film treating tank in a disc film treating unit in which a series of treatments are carried out for developing disc films.

4. A disc fillm treating cassette as defined in claim 1, wherein the disc film support shaft includes a larger diameter stopper of which position is so determined that its lower end is located slightly above the light shielding plate when it is slidably displaced upwardly in the axial direction of the housing and another larger diameter stopper which permits disc films carried by the shaft to be immersed in treating liquid in the disc film treating tank to carry out a series of treatments for developing disc films when it is slidably displaced downwardly.

5. A disc film treating cassette as defined in claim 1, wherein the disc film supporting shaft includes a support member at the lower end thereof which serves to immovably support several disc films in a closely spaced relation in such a manner as to inhibit them from being rotated and displaced up and down relative to said shaft.

6. A disc film treating cassette as defined in claim 5, wherein said support member comprises a plurality of leaf springs which are formed with projections for immovably holding disc films, said projections being located offset from one another by a short distance in the vertical direction.

7. A disc film treating cassette as defined in claim 6, wherein said leaf springs are fitted into a plurality of axially extending grooves which are formed at the lower end part of the disc film support shaft in the equally spaced relation in the circumferential direction of the shaft, the upper end part of each of the leaf springs being fixedly held in the groove and each of said projections and a part located in the vicinity of the projection being projected outwardly of the groove.

* * * * *